United States Patent [19]

Quinlan

[11] 4,212,764

[45] Jul. 15, 1980

[54] QUATERNARY POLYVINYL HETEROCYCLIC COMPOSITIONS AND USE AS CORROSION INHIBITORS

[75] Inventor: Patrick M. Quinlan, Webster Groves, Mo.

[73] Assignee: Petrolite Corporation, St. Louis, Mo.

[21] Appl. No.: 268,549

[22] Filed: Jul. 3, 1972

[51] Int. Cl.[2] ..... C23F 11/14; C23F 11/12

[52] U.S. Cl. ..... 252/392; 252/8.55 E; 252/148; 252/180; 252/390; 106/14.13; 106/14.16; 422/12

[58] Field of Search ..... 252/390, 392, 8.55 E, 252/148, 180; 21/2.7 R, 2.5 R; 106/14, 14.13, 14.16; 260/290 R; 422/12

[56] References Cited

U.S. PATENT DOCUMENTS

| | | | |
|---|---|---|---|
| 3,352,873 | 11/1967 | Cislak et al. | 252/390 |
| 3,382,179 | 5/1968 | Keeney et al. | 252/390 |
| 3,466,188 | 9/1969 | Annand | 252/390 |
| 3,591,512 | 7/1971 | Leeds | 252/392 |
| 3,658,720 | 4/1972 | McDougall et al. | 252/392 |
| 3,779,935 | 12/1973 | McDougall et al. | 252/390 |
| 3,802,890 | 4/1974 | Keeney | 252/390 |

*Primary Examiner*—Benjamin R. Padgett
*Assistant Examiner*—Irwin Gluck
*Attorney, Agent, or Firm*—Sidney B. Ring; Hyman F. Glass

[57] ABSTRACT

Quaternary polyvinyl heterocyclic compositions, as illustrated by polyvinyl pyridine and copolymers thereof, and their use as corrosion inhibitors which are particularly effective in acid systems.

13 Claims, No Drawings

QUATERNARY POLYVINYL HETEROCYCLIC COMPOSITIONS AND USE AS CORROSION INHIBITORS

This invention relates to quaternary polyvinyl heterocyclic compounds and the use thereof as corrosion inhibitors, particularly in acid systems. More particularly, this invention relates to quaternary polyvinyl heterocyclic compounds as illustrated by those derived from the following type of vinyl heterocyclics: vinyl pyridine, vinyl pyrazine, vinyl piperidine, vinyl quinoline, alkylated vinyl pyridine, alkylated pyrazine, alkylated vinyl piperidine, alkylated vinyl quinoline, etc. One type of which may be used in the preparation of the herein described compounds has been characterized for purposes of convenience as a nitrogen-containing vinyl-substituted heterocyclic. By "nitrogen-containing vinyl-substituted heterocyclic" is meant any chemical compound which has as a part of its structure a ring system containing nitrogen as a part of the cyclic system, and further has as a substitutent upon this cyclic unit a vinyl or a substituted vinyl group. This general specification includes a diverse group of materials. For instance, the heterocyclic ring may be an essentially aromatic ring such as pyridine or pyrazine, a fused ring system such as quinoline, or a non-aromatic ring such as piperidine. The essential structural element is the presence of one or more nitrogen atoms in the cyclic structure which are capable of entering into reaction with compounds such as halogen atoms capable of producing substituted nitrogen atoms or quaternary compounds. Further, there should be as a substitutent on the ring a vinyl or substituted vinyl group capable of inducing in the molecule a tendency toward polymerization by the usual vinyl polymerization mechanisms.

The following specific examples of compounds which may be employed for the purpose previously specified in this section are cited by way of illustration and are not to be construed as limiting the scope of the invention.

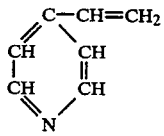

4-vinyl pyridine

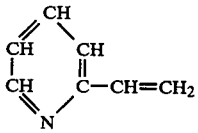

2-vinyl pyridine

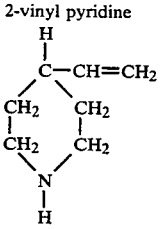

4-vinyl piperidine

-continued

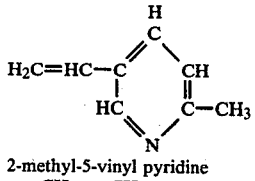

2-methyl-5-vinyl pyridine

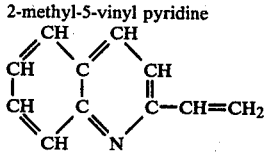

2-vinyl quinoline

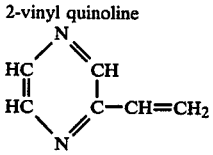

2-vinyl pyrazine

As corrosion inhibitors these nitrogen groups are adsorptively active groups, i.e., are adsorbed on the metal. The preceding six formulae illustrate a number of suitable compounds which are particularly suited for use in the present invention. However, other well known compounds can be substituted for these particular ones without departing from the spirit of the invention.

When 4-vinyl pyridine is quaternized with alkyl halides spontaneous polymerization occurs to give the corresponding poly (4-vinyl pyridinium) compound. For specific information on the preparation of polypyridiniums, reference is made to (1) V. A. Kobanov, et al., *J. Polym. Sci.*, Part C, 16, 1079 (1967). (2) V. A. Kobanov, et al., *J. Polym. Sci.*, Part C, 23, 357 (1968). (3) I. Nielke and H. Ringsdorf, *Polymer Letters*, 9, 1 (1971).

Kabonov and Kargin have shown that at the temperatures above 5° C. the reaction of 4-vinyl pyridine with alkyl halides (Menshutkin's reaction) in organic media (benzene, nitrobenzene, acetonitrile, dimethyl sulfoxide, propylene carbonate, methanol) leads not to the expected monomer salts, but to the polymers of the general formula:

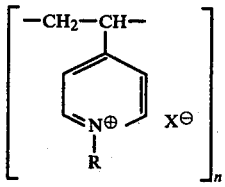

The general procedure may be illustrated by the following examples:

EXAMPLE 1

A mixture of 10.5 g. of 4-vinyl pyridine, 12.4 g. of benzyl chloride, and 69 g. of methanol was heated at reflux under a nitrogen blanket, for a period of 24 hours. The resulting polymer solution was viscous and water soluble.

EXAMPLE 2

A mixture of 10.5 g. of 4-vinyl pyridine, 13.7 g. of butyl bromide, and 48.4 g. of methanol was heated at reflux, under a nitrogen blanket, for a period of 24 hours. The resulting polymer solution was viscous and water soluble.

EXAMPLE 3

A mixture of 10.5 g. of 4-vinyl pyridine, 15.6 g. of ethyl iodide, and 54.2 g. of methanol was heated at reflux, under a nitrogen blanket, for a period of 24 hours. The resulting polymer solution was viscous and water soluble.

EXAMPLE 4

A mixture of 10.5 g. of 4-vinyl pyridine, 25 g. 1-bromododecane, and 71 g. of methanol was heated under $N_2$ at reflux for 48 hours to yield a polymer solution.

EXAMPLE 5

A mixture of 10.5 g. of 4-vinyl pyridine, 29.2 g. of dodecylbenzyl chloride, and 79.4 g. of methanol was heated at reflux, under a nitrogen blanket, for a period of 24 hours to yield a polymer solution.

EXAMPLE 6

A mixture of 10.5 g. of 4-vinyl pyridine, 16.7 g. of ethyl bromoacetate, and 54.4 g. of methanol was heated at reflux, under a nitrogen blanket, for a period of 24 hours to yield a polymer solution.

I prefer to use heterocyclic compounds which have only one ring and especially pyridine and pyridine derivatives as, for example, monoalkylated or dialkylated vinyl pyridine, preferably having from 1 to 6 carbon atoms on the alkyl group.

In addition to the aforementioned procedure, samples of various polyvinylpyridines may be quaternized by alkyl halides in organic media. The following examples serve as illustrations.

EXAMPLE 7

Into a reaction vessel were charged 10.5 g. (0.1 eqv.) of *Ionac PP-2000, 14.2 g. (0.1 eqv.) of methyl iodide and 74.1 g. of methanol. This solution was mixed and heated at reflux for 24 hours. The polymeric salt was isolated by precipitation with diethyl ether, vacuum filtered, and dried in a vacuum dessicator.

*A polymer of 2-vinyl pyridine (Ionac Chemical Co.) having an intrinsic viscosity of 0.80–1.20.

EXAMPLE 8

Into a reaction vessel were charged 11.8 g. (0.1 eqv.) of *Ionic PP-2020, 12.7 g. (0.1 eqv.) of benzyl chloride, and 49 g. of methanol. This mixture was heated at reflux for 24 hours.

*A polymer of 2-methyl, 5-vinyl pyridine.

EXAMPLE 9

Into a reaction vessel were charged 11 g. (0.1 eqv.) of *Ionac PP-2040, 14.2 g. (0.1 eqv.) of methyl iodide and 50.4 g. of methanol. This solution was mixed and heated at reflux for 24 hours. The polymeric salt was isolated by precipitation and drying.

*Copolymer of 2-vinyl and 2-methyl, 5-vinyl pyridine.

EXAMPLE 10

In a similar manner as in Example 8, 11.8 g. of Ionac PP-2020 was reacted with 15.6 g. of ethyl iodide.

EXAMPLE 11

In a similar manner as in Example 8, 11.8 g. of Ionac PP-2020 was reacted with 13.7 g. of butyl bromide.

EXAMPLE 12

In a similar manner as in Example 9, 11.0 g. of Ionac PP-2040 was reacted with 12.3 g. of propyl bromide.

EXAMPLE 13

In a similar manner as in Example 8, 11.8 g. of Ionac PP-2020 was reacted with 29.2 g. of dodecyl benzyl chloride.

While the polymeric quaternary salts of this invention are in themselves excellent acid corrosion inhibitors, there may be added to them such materials as acetylenic alcohols, for example, propargyl alcohol, 2, 5-dimethyl-3-butyn-2, 5-diol, butyne diol, 1-hexyn-3-ol, 1-octyn-3-ol, 1-propyn-3-ol, 3-methyl-1-butyn-3-ol and the like.

In addition, there may be added separately to the polymeric quaternary salts, or in conjunction with the acetylene materials, non-ionic surface active materials. Among these may be included oxy-alkylated phenols, amines, amides, and the like.

EXAMPLE 14

90 Parts by weight of the polymeric quaternary ammonium salt solution described in Example 3 were mixed with 10 parts of nonyl phenyl (1 mole) ethoxylated with 15 moles of ethylene oxide.

EXAMPLE 15

90 Parts by weight of the polymeric quaternary ammonium salt solution described in Example 2 were mixed with 10 parts of nonyl phenol (1 mole) ethoxylated with 10 moles of ethylene oxide.

EXAMPLE 16

90 Parts by weight of the polymeric quaternary ammonium salt solution described in Example 9 were mixed with 10 parts of nonyl phenol (1 mole) ethoxylated with 15 moles of ethylene oxide.

EXAMPLE 17

90 Parts by weight of the polymeric quaternary ammonium salt solution described in Example 1 were mixed with 10 parts of nonyl phenol (1 mole) ethoxylated with 15 moles of ethylene oxide.

EXAMPLE 18

75 Parts by weight of the polymeric quaternary ammonium salt solution described in Example 2 were mixed with 25 parts of OW-1, a proprietary acetylenic mixture manufactured by Air Products and Chemicals.

EXAMPLE 19

60 Parts by weight of the polymeric quaternary ammonium salt solution described in Example 2 were mixed with 30 parts of propargyl alcohol, and 10 parts of nonyl phenol (1 mole) ethoxylated with 15 moles of ethylene oxide.

EXAMPLE 20

75 Parts by weight of the polymeric quaternary ammonium salt solution described in Example 1 were mixed with 25 parts by weight of propargyl alcohol.

The above examples are summarized in the following table:

Table A

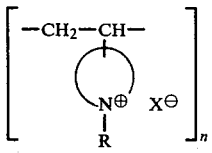

| Ex. | Poly (vinyl pyridine) | R | X | Other Components |
|---|---|---|---|---|
| 1 | Poly (4-vinyl pyridine) | benzyl | Cl | |
| 2 | Poly (4-vinyl pyridine) | butyl | Br | |
| 3 | Poly (4-vinyl pyridine) | ethyl | I | |
| 4 | poly (4-vinyl pyridine) | dodecyl | Br | |
| 5 | Poly (4-vinyl pyridine) | dodecyl-benzyl | Cl | |
| 6 | Poly (4-vinyl pyridine) | ethyl acetate | Br | |
| 7 | Poly (2-vinyl pyridine) | methyl | I | |
| 8 | Poly (2-methyl-5-vinyl pyridine) | benzyl | Cl | |
| 9 | Copoly (2-vinyl & 2-methyl-5 vinyl-pyridine) | methyl | I | |
| 10 | Poly (2-methyl, 5-vinyl pyridine) | ethyl | I | |
| 11 | Poly (2-methyl, 5-vinyl pyridine) | butyl | Br | |
| 12 | Copoly (2-vinyl & 2-methyl, 5-vinyl pyridine) | propyl | Br | |
| 13 | Poly (2-methyl, 5-vinyl pyridine) | dodecyl benzyl | Cl | |
| 14 | Ex. 3 | ethyl | I | nonyl $C_6H_4$-$(OCH_2CH_2)_{15}OH$ |
| 15 | Ex. 2 | butyl | Br | nonyl $C_6H_4$-$(OCH_2CH_2)_{10}OH$ |
| 16 | Ex. 9 | methyl | I | nonyl $C_6H_4$-$(OCH_2CH_2)_{15}OH$ |
| 17 | Ex. 1 | benzyl | Cl | nonyl $C_6H_4$-$(OCH_2CH_2)_{15}OH$ |
| 18 | Ex. 2 | butyl | Br | OW-1 (Acetylenic alcohol) |
| 19 | Ex. 2 | butyl | Br | Propargyl alcohol nonyl $C_6H_4$-$(OCH_2CH_2)_{15}OH$ |
| 20 | Ex. 1 | benzyl | Cl | Propargyl alcohol |

In general, the polymers produced from olefinic unsaturation will contain the following recurrent structural unit:

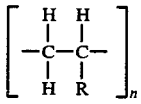

wherein n is a number from about 3 to about 250, preferably about 3 to about 20, and R is an adsorptively active group as discussed above. Such polymers may be produced at least in part by addition polymerization of a monomer containing a vinyl moiety. For example 4-vinylpyridine can polymerize to poly (vinylpyridine). Poly(vinylpyridine) can be hydrogenated to poly(vinylpiperidine).

It is also feasible to polymerize a monomer containing a vinylene moiety, in which case the recurrent unit would contain a substituent on each chain carbon in the unit. Of course, both of the substituents can be adsorptively active groups, or one may be adsorptively active while the other is adsorptively inert, such as in the case of alkyl or phenyl. Further, the chain carbons may contain additional groups thereon, that is, two substituents on a single chain carbon.

Quarternaries of Copolymers made in accordance with the invention are also useful in inhibiting corrosion. For example, 4-vinylpyridine and methyl acrylate, acrylamide, or acrylonitrile can be copolymerized to form a corrosion-inhibiting molecule. Styrene sulfonic acid (acid in 2 or 4 position probably) is also a useful monomer in respect to the invention. Likewise, monomers without adsorptively active groups, such as ethylene and styrene, can be copolymerized with monomers having adsorptively active groups to form molecules having a plurality of adsorptive sites. In addition, the polymer once made can be modified by suitable techniques, for example, hydrolysis, oxidation or hydrogenation, to effect desirable characteristics. Of course, the bonding power per unit weight in some instances may be reduced, but to attain certain characteristics, such as solubility in a particular environment, these techniques may be advantageously employed.

Although persons in the art will understand that particular groups present directly on the carbon chain, or in an adsorptively active group which is a substituent on the chain, are preferably selected with a view towards use in a particular corrosive environment, the selection may be made, for example, from the following groups which are representative of the broad classes of groups which may be employed, assuming of course that valence requirements in the final product are satisfied:

| | |
|---|---|
| methyl | xylyl |
| ethyl | methylene |
| propyl | nonoxycarbonyl |
| butyl | ethenyl |
| octyl | butenyl |
| dodecyl | cyclohexyl |
| hexadecyl | octylcyclohexyl |
| octadecyl | ethylene |
| phenyl | propylene |
| tolyl | butylene |
| methylcarbonylmethyl | octylene |
| butylcarbonylethyl | dodecylene |
| nonylcarbonylmethyl | phenylene |
| methoxycarbonyl | chloro |
| butoxycarbonyl | bromo |
| p-chlorophenyl | iodo |
| p-bromophenyl | carboxyl |
| p-iodophenyl | cycloheptyl |
| methoxymethyl | cyclohexenyl |
| butoxymethyl | acetyl |
| nonoxymethyl | hydroxy |
| nonoxybutyl | tetracosyl |
| dodecylphenyl | |

Broadly, alkyl, alkylene, aryl, alkoxyalkyl, arylene, halo, carboxyl, alkoxycarbonyl, alkenyl, cycloalkyl, cycloalkenyl, acyl, alkylcarbonyalkyl, and hydroxy may be advantageously employed, particularly upon consideration of the intended corrosive environment. In general, a substituent on the carbon chain may contain up to about 24 carbons or more.

Particularly effective inhibitors are quaternaries of poly(vinylpyridine), poly(vinylpiperidine), poly(vinylpyridine-acrylic acid), and poly(vinylpyridine-methyl acrylate). Excellent inhibiting characteristics have been observed in the polymers containing a derivative group of a heterocyclic nitrogen compound, such as vinylpiperidine, vinylpyridine, and the vinylalkylenimines in general, and polymers (which term includes copolymers) containing at least one, preferably at least 5, of these groups for every 20 carbons in the carbon chain are preferred compounds for protection of materials subject to corrosion.

Quaternaries of the above co-polymers can be formed by methods previously described. For instance, see Examples 7 through 13. Quaternaries of the above copolymers make excellent corrosion inhibitors.

These heterocyclic nitrogen compounds are generally quaternized by alkylation.

Thus, the term "alkylation" as employed herein and in the claims include alkenylation, cycloalkenylation, aralkylation, etc., and other hydrocarbonylation as well as alkylation itself.

Any hydrocarbon halide, e.g., alkyl, alkenyl, cycloakenyl, aralkyl, etc., halide which contains at least one carbon atom and up to about thirty carbon atoms or more per molecule can be employed to alkylate the products of this invention. It is especially preferred to use alkyl halides having between about one to about eighteen carbon atoms per molecule. The halogen portion of the alkyl halide reactant molecule can be any halogen atom, i.e., chlorine, bromine, fluorine, and iodine. In practice, the alkyl bromides and chlorides are used, due to their greater commercial availability. Nonlimiting examples of the alkyl halide reactant are methyl chloride; ethyl chloride; propyl chloride; n-butyl chloride; sec-butyl iodide, t-butyl fluoride, n-amyl bromide, isoamyl chloride, n-hexyl bromide, n-hexyl iodide; heptyl fluoride; 2-ethyl-hexyl chloride; n-octyl bromide; decyl iodide; dodecyl bromide; 7-ethyl-2-methyl-undecyl iodide; tetradecyl bromide; hexadecyl bromide; hexadecyl fluoride; heptadecyl chloride; octadecyl bromide; doscyl chloride; tetracosyl iodide; hexacosyl bromide, octacosyl chloride; and triacontyl chloride. In addition, alkenyl halides can also be employed, for example, the alkenyl halides corresponding to the above examples. Examples of aryl halides include benzyl halides, alkylbenzyl halides, etc.

The alkyl halides can be chemically pure compounds or of commercial purity.

Another type of quaternizing agent which can be employed is a halocarbon containing other elements beside halogen, carbon and hydrogen such as for example those of the general formula $$X-Z-\overset{\overset{\displaystyle O}{\|}}{C}-A$$

where Z is an alkylene group for example $(CH_2)_n$, X is halogen and A represents a member selected from the group consisting of —R which represents an alkyl group of for example having 1–4 carbons, a phenyl group or a substituted phenyl group, e.g., methyl, ethyl, propyl, isopropyl, butyl, phenyl, monohydroxyphenyl, dihydroxyphenyl, acetamidophenyl, etc. groups, an alkoxy group —$OR_1$ represents an alkyl group of from 1 to 24 carbon atoms e.g., methyl, ethyl, propyl, isopropyl, butyl, pentyl, hexyl, decyl, dodecyl, hexadecyl, octadecyl, nonadecyl, eicosyl, heneicosyl, behenyl, carnaubyl, etc. groups, and an amino group —$NR_2R_3$, wherein $R_2$ represents a hydrogen atom or an alkyl group of 1 to 4 carbon atoms and $R_3$ represents a hydrogen atom, or an alkyl group of 1 to 4 carbon atoms or a phenyl group, for example haloketones. Typical haloketones that can be used advantageously in the above reaction include halogen substituted ketones such as chloroacetone, bromoacetone, chloromethyl ethyl ketone, bromomethyl ethyl ketone, a-chloroacetophenone, p-chloroacetophenol, p-chloroacetylacetanilide, chloroacetopyrocatechol, etc. and the corresponding bromine derivatives wherein a bromine atom replaces the chlorine atom in each instance. These compositions may also be esters, for example haloesters. Typical alkyl esters of chloroacetic and bromoacetic acids that can be used advantageously include methyl chloroacetate, ethyl chloroacetate, propyl chloroacetate, isopropyl chloroacetate, the butyl chloroacetates, the hexyl chloroacetates, the decyl chloroacetates, the dodecyl chloroacetates, the hexadecyl chloroacetates, the octadecyl chloroacetates, the eicosyl chloroacetates, the carnaubyl chloroacetates, etc., and the corresponding esters of bromoacetic acid. In general, the normal alkyl esters are preferred; haloamides may also be used. Typical examples include chloroacetamide, α-chloro-N-methylacetamide, α-chloro-N-butyl acetamide, α-chloro, N,N-diethylacelamide, α-chloro-n-ethylacetanilide, etc.

The anion (X) employed will depend on the properties desired for example solubility, insolubility, partial solubility. Example of anions include sulfates, bisulfates, sulfites, bisulfites, halides, i.e., Cl, Br, I, F, etc., phosphates, phosphites, etc., chlorates, etc.

Any suitable quaternizing agent may be employed, for example, (1) alkyl halides such as methyl iodide, butyl iodide, butyl bromide, etc.

(2) Sulfuric acid and derivatives $H_2SO_4$, $R_2SO_4$ where R is alkyl, etc., methyl, ethyl, etc. for example $(Me)_2SO_4$ (3) Alkyl thioureas such as methyl thiourea, etc.

(4) Sulfonate esters, for example

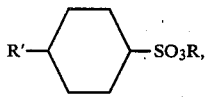

where R' is alkyl such as methyl, etc., and R is hydrogen, alkyl, etc., for example, methyl p-toluene sulfonates.

(5) Alkyl phosphates, e.g. $(MeO)_3PO$, $(EtO)_3PO$, etc. The corrosion inhibiting properties of the quaternary polymers can be further enhanced by presence of non-ionic surfactants or non-ionic surfactants and hydroxy compounds.

The hydroxy compounds of this invention are alcohol compounds such as alkanols, alkenols, alkynols, glycols, polyols, etc.

Representative examples comprise one or more hydroxylic compounds such as methanol, ethanol, isopropanol, n-propanol, ethylene-glycol, propargyl alcohol, 2-methyl-3 butyn-2-ol, 2,5-dimethyl-3-butyn-2,5-diol, butynediol, 1-hexyn-3-ol, 1-octyn-3-ol, 1-propyn-3-ol, 3-methyl-1-butyn-3-ol.

A preferred commercial hydroxy composition is OW-1 sold by Airco Products which is a proprietary mixture of acetylenic compounds.

Although the quaternary polymers can be employed alone, it is preferably employed as a mixture, for example, from about 25 to 90% of the quaternary polymers, such as from about 25 to 80, but preferably from about 30 to 75; from about 10 to 25% of the surfactant, such as from about 10 to 20, but preferably from about 10 to 15; and from about 15 to 75% of the alcohol, such as from about 15 to 50, but preferably from about 15 to 40. In practice, the composition generally contains some water in order to render the composition more fluid.

The surfactant employed in conjunction with the quaternary polymer should be soluble or dispersable in the corrosion inhibiting system. In general it is an oxyalkylated material which is water soluble or dispersible so that it enhances corrosion inhibition.

Any suitable surfactant can be employed. The surfactants which are most usually employed in the practice of this invention are oxyalkylated surfactants or more specifically poly-alkylene ether or polyoxyalkylene surfactants. Oxyalkylated surfactants as a class are well known. The possible sub-classes and specific species are legion. The methods employed for the preparation of such oxyalkylated surfactants are also too well known to require much elaboration. Most of these surfactants contain, in at least one place in the molecule and often in several places, an alkanol or a polyglycolether chain. These are most commonly derived by reacting a starting molecule, possessing one or more oxyalkylatable reactive groups, with an alkylene oxide such as ethylene oxide, propylene oxide, butylene oxide, etc. However, they may be obtained by other methods such as shown in U.S. Pat. Nos. 2,588,771 and 2,596,091-3, or by esterification or amidification with an oxyalkylated material, etc. Mixtures of oxides may be used as well as successive additions of the same or different oxides may be employed. Any oxyalkylatable material may be employed. As typical starting materials may be mentioned alkyl phenols, phenolic resins, alcohols, glycols, amines, organic acids, carbohydrates, mercaptans, and partial esters of polybasic acids. In general, the art teaches that, if the starting material is water-soluble, it may be converted into an oil-soluble surfactant by the addition of polypropoxy or polybutoxy chains. If the starting material is oil-soluble, it may be converted into a water soluble product. Subsequent additions of ethoxy units to the water-soluble surfactant by the addition of polyethoxy chains tend to increase the water solubility, while, subsequent additions of high alkoxy chains tend to increase the oil solubility. In general, the final solubility and surfactant properties are a result of a balance between the oil-soluble and water-soluble portions of the molecule.

In the practice of this invention I have found that suitable surfactants may be prepared from a wide variety of starting materials. For instance, if I begin with an oil-soluble material such as a phenol or a long chain fatty alcohol and prepare a series of products by reaction with successive portions of ethylene oxide, I find that the members of the series are successively more water-soluble. Similarly it is possible to start with water or a water-soluble material such as polyethylene glycol and add, successively, portions of propylene oxide. The members of this series will be progressively less water-soluble and more oil-soluble. There will be a preferred range where the materials are useful for the practice of this invention.

In general, the compounds which would be selected are oxyalkylated surfactants of the general formula $$Z[(OA)_nOH]_m$$

wherein Z is the oxyalkylatable material, A is the radical derived from the alkylene oxide which can be, for example, ethylene, propylene, butylene, and the like, n is a number determined by the moles of alkylene oxide reacted, for example 1 to 2,000 or more and m is a whole number determined by the number of reactive oxyalkylatable groups. Where only one group is oxyalkylatable as in the case of a monofunctional phenol or alcohol R'OH, then m=1. Where Z is water, or a glycol, m=2. Where Z is glycerol, m=3, etc.

In certain cases, it is advantageous to react alkylene oxides with the oxyalkylatable material in a random fashion so as to form a random copolymer on the oxyalkylene chain, i.e., the $[(OR)_nOH]_m$ chain such as —AABAAABBABABBABBA—. In addition, the alkylene oxides can be reacted in an alternate fashion to form block copolymers on the chain, for example —BBBAAABBBAAAABBBB— or —BBBBAAACCCAAAABBBB— where A is the unit derived from one alkylene oxide, for example ethylene oxide, and B is the unit derived from a second alkylene oxide, for example propylene oxide, and C is the unit derived from a third alkylene oxide, for example, butylene oxide, etc. Thus, these compounds include terpolymers or higher copolymers polymerized randomly or in a blociwise fashion or many variations of sequential additions.

Thus, $(OR)_n$ in the above formula can be written $—A_aB_bC_c—$ or any variation thereof, wherein a, b and c are 0 or a number provided that at least one of them is greater than 0.

It cannot be overemphasized that the nature of the oxyalkylatable starting material used in the preparation of the emulsifier is not critical. Any species of such material can be employed. By proper additions of alkylene oxides, this starting material can be rendered suitable as a surfactant and its suitability can be evaluated by testing in the corrosion system.

REPRESENTATIVE EXAMPLES OF Z

| No. | Z |
|---|---|
| 1 | $RC(=O)-O-$ |
| 2 | 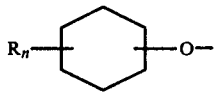 |
| 3 | $R-O-$ |
| 4 | $R-S-$ |
| 5 | $R-C(=O)-N(H)-$ |
| 6 | $R-C(=O)-N<$ |
| 7 | $R-N(H)-$ |
| 8 | $RN<$ |
| 9 | Phenol-aldehyde resins. |
| 10 | —O— (Ex: Alkylene oxide block polymers). 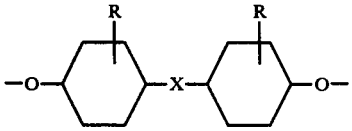 |
| 11 | X=O, $-S-$, $-CH_2-S(=O)_2-$, etc. |
| 12 | $R-S-CH_2C(=O)-O-$ |
| 13 | $RPO_4H$ |
| 14 | $RPO_4=$ |
| 15 | $PO_4=$ |
| 16 | 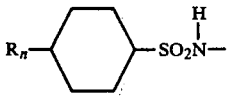 |
| 17 | 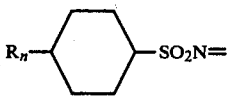 |
| 18 | 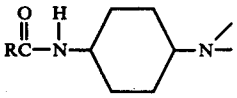 |
| 19 | Polyol-derived (Ex: glycerol, glucose, pentaerithrytol). |
| 20 | Anydrohexitan or anhydrohexide derived (Spans and Tweens). |
| 21 | Polycarboxylic derived. |
| 22 | $-(CHCH_2-O)_n-$ 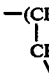 amino |

Examples of oxyalkylatable materials derived from the above radicals are legion and these, as well as other oxyalkylatable materials, are known to the art. A good source of such oxyalkylatable materials, as well as others, can be found in "Surface Active Agents and Detergents," vols. 1 and 2, by Schwartz et al., Interscience Publishers (vol. 1, 1949, vol. 2, 1958), and the patents and references referred to therein.

USE IN ACID SYSTEMS

The compounds of this invention can be employed as corrosion inhibitors for acid systems, for example as illustrated by the pickling of ferrous metals, the treatment of calcareous earth formations, etc., as described in the following sections.

USE AS PICKLING INHIBITORS

This phase of the invention relates to pickling. More particularly, the invention is directed to a pickling composition and to a method of pickling ferrous metal. The term "ferrous metal" as used herein refers to iron, iron alloys and steel.

To prepare ferrous metal sheet, strip, etc., for subsequent processing, it is frequently desirable to remove oxide coating, formed during manufacturing, from the surface. The presence of oxide coating, referred to as "scale" is objectionable when the material is to undergo subsequent processing. Thus, for example, oxide scale must be removed and a clean surface provided if satisfactory results are to be obtained from hot rolled sheet and strip in any operation involving deformation of the product. Similarly, steel prepared for drawing must possess a clean surface and removal of the oxide scale therefrom is essential since the scale tends to shorten drawing-die life as well as destroy the surface smoothness of the finished product. Oxide removal from sheet or strip is also necessary prior to coating operations to permit proper alloying or adherence of the coating to the ferrous metal strip or sheet. Prior to cold reduction, it is necessary that the oxide formed during hot rolling be completely removed to preclude surface irregularities and enable uniform reduction of the work.

The chemical process used to remove oxide from metal surfaces is referred to as "pickling." Typical pickling processes involve the use of aqueous acid solutions, usually inorganic acids, into which the metal article is immersed. The acid solution reacts with the oxides to form water and a salt of the acid. A common problem in this process is "overpickling" which is a condition resulting when the ferrous metal remains in the pickling solution after the oxide scale is removed from the surface and the pickling solution reacts with the ferrous base metal. An additional difficulty in pickling results from the liberated hydrogen being absorbed by the base metal and causing hydrogen embrittlement. To overcome the aforementioned problems in pickling, it has been customary to add corrosion inhibitors to the pickling solution.

The present invention avoids the above-described problems in pickling ferrous metal articles and provides a pickling composition which minimizes corrosion, overpickling and hydrogen embrittlement. Thus the pickling inhibitors described herein not only prevent excessive dissolution of the ferrous base metal but effectively limit the amount of hydrogen absorption thereby during pickling. According to the invention, a pickling composition for ferrous metal is provided which comprises a pickling acid such as sulfuric or hydrochloric acid and a small but effective amount of the corrosion inhibitors of this invention.

Ferrous metal articles are pickled by contacting the surface (usually by immersion in the pickling solution) with a pickling composition as described to remove oxide from their surface with minimum dissolution and hydrogen embrittlement thereof and then washing the ferrous metal to remove the pickling composition therefrom.

USE IN ACIDIZING EARTH FORMATIONS

The compositions of this invention can also be used as corrosion inhibitors in acidizing media employed in the treatment of deep wells to reverse the production of petroleum or gas therefrom and more particularly to an improved method of acidizing a calcareous or magnesium oil-bearing formation.

It is well known that production of petroleum or gas from a limestone, dolomite, or other calcareous-magnesian formation can be stimulated by introducing an acid into the producing well and forcing it into the oil or gas bearing formation. The treating acid, commonly a mineral acid such as HCl, is capable of forming water soluble salts upon contact with the formation and is effective to increase the permeability thereof and augment the flow of petroleum to the producing well.

The corrosion inhibitors were evaluated using sand blasted 1020 mild steel coupons. Clean, weighed mild steel coupons were placed in different vessels each of which contained 15% HCL at test temperatures. After a 4-hour test period, the coupons were removed from the acid, neutralized, washed with water, rinsed with acetone, dried, and weighed. The percent inhibition was calculated by the following equation:

$$\text{Percent protection} = \frac{W_1 - W_2}{W_1} \times 100$$

where $W_1$ is coupon weight loss without inhibitor where $W_2$ is coupon weight loss in presence of inhibitor.

The utility of the compositions of this invention is illustrated in the following Tables.

| Compound | conc. (p.p.m.) | % Inhibition |
|---|---|---|
| Example 1 | 2,000 | 93.0 |
| Example 2 | 2,000 | 93.0 |
| Example 3 | 2,000 | 93.5 |
| Example 9 | 2,000 | 88.0 |

| Compound | conc. (p.p.m.) | % Inhibition |
|---|---|---|
| Example 1 | 4,000 | 91.0 |
| Example 2 | 4,000 | 87.5 |
| Example 3 | 4,000 | 93.5 |
| Example 9 | 4,000 | 80.0 |
| Example 10 | 4,000 | 92.0 |
| Example 11 | 4,000 | 82.5 |
| Example 14 | 4,000 | 91.5 |
| Example 15 | 4,000 | 89.0 |
| Example 16 | 4,000 | 87.0 |
| Example 17 | 4,000 | 91.0 |
| Example 18 | 4,000 | 94.5 |
| Example 19 | 4,000 | 97.5 |
| Example 20 | 4,000 | 98.0 |

| Compound | conc. (p.p.m.) | % Inhibition |
|---|---|---|
| Example 2 | 2,500 | 98.5 |
| Example 3 | 2,500 | 98.5 |
| Example 7 | 2,500 | 89.0 |
| Example 10 | 2,500 | 99.5 |
| Example 11 | 2,500 | 98.0 |
| Example 9 | 2,500 | 89.0 |

| | | |
|---|---|---|
| Example 2 | 2,500 | 98.5 |
| Example 3 | 2,500 | 99.5 |
| Example 7 | 2,500 | 85.0 |
| Example 10 | 2,500 | 98.2 |
| Example 11 | 2,500 | 96.4 |
| Example 9 | 2,500 | 87.5 |

The superiority of the quaternary polymers over the non-quaternary polymers is illustrated by the following corrosion tests on the non-quaternary polymers. It is noted that in contrast to the 90+% protection obtained by the quaternary polymers, the following non-quaternary polymers gave less than 80% protection.

Table 5

15% HCl
200° F., 4 hour test
mild steel coupons

| Compound | conc. (p.p.m.) | % Inhibition |
|---|---|---|
| Poly-4-vinyl pyridine | 4,000 | 79.0 |
| Poly-2-Methyl-5 vinylpyridine(2) | 4,000 | 78.0 |
| Copolymer of 2-vinyl and 2-methyl, 5-vinyl pyridine(3) | 4,000 | 75.5 |
| Poly-2-vinyl pyridine(4) | 4,000 | 79.5 |

(1)Intrinsic viscosity of 1.0
(2)Intrinsic viscosity of 0.8 - 1.2
(3)Intrinsic viscosity of 0.8 - 1.2
(4)Intrinsic viscosity of 0.8

The amount of the compositions of this invention employed in treating the corrosive systems of this invention will vary with the particular compound employed, the particular system, the solids present in the system, the degree of corrosivity of the system, etc. A minor amount of the compound is generally employed sufficient to impart corrosion protection to the system. In general one employs concentration of trace amounts such as from about 1.0 p.p.m. to 10,000 p.p.m., for example from about 5 to 5,000 p.p.m., such as from 500 to 4,500 p.p.m., but preferably from about 1,000–4,000 p.p.m. In practice, concentrations of about 1,000 to 2,000 p.p.m. are employed.

As is quite evident, other quaternary polymers of this invention will be constantly developed which could be useful in this invention. It is, therefore, not only impossible to attempt a comprehensive catalogue of such compositions, but to attempt to describe the invention in its broader aspects in terms of specific chemical names used would be too voluminous and unnecessary since one skilled in the art could by following the description of the invention herein select a useful quaternary polymer. This invention lies in the use of suitable quaternary polymers as corrosion inhibitors in acid systems and their individual compositions are important only in the sense that their properties can affect this function. To precisely define each specific useful quaternary polymer and acid system in light of the present disclosure would merely call for knowledge within the skill of the art in a manner analogous to a mechanical engineer who prescribes in the construction of a machine the proper materials and the proper dimensions thereof. From the description in this specification and with the knowledge of a chemist, one will know or deduce with confidence the applicability of specific quaternary polymers suitable for this invention by applying them in the process set forth herein. In analogy to the case of a machine, wherein the use of certain materials of construction or dimensions of part would lead to no practical useful result, various materials will be rejected as inapplicable where others would be operative. I can obviously assume that no one will wish to use a useless quaternary polymer nor will be misled because it is possible to misapply the teachings of the present disclosure to do so. Thus, any quaternary polymer or mixtures containing them that can perform the function stated herein can be employed.

I claim:

1. A process of inhibiting corrosion in a system which comprises treating said system with a mixture comprising a quaternary polymer of vinyl pyridine, vinyl pyrazine, vinyl piperidine, vinyl quinoline, derivatives or copolymers thereof and an oxyalkylated surfactant of the formula $$Z[(OA)_nOH]_m$$

where Z is the oxyalkylatable moiety of an oxyalkylatable compound $Z(OH)_m$, A is the alkylene moiety of an alkylene oxide, and n is a number from 1 to 2,000.

2. The process of claim 1 where the polymer is a quaternary polymer of a vinyl pyridine or copolymers thereof.

3. The process of claim 2 where the vinyl pyridine is 4-vinyl pyridine, 2-vinyl pyridine, 2-methyl-5-vinyl pyridine, derivatives or copolymers thereof.

4. A corrosion inhibiting composition of matter comprising a quaternary polymer of vinyl pyridine, vinyl pyrazine, vinyl piperidine, vinyl quinoline, derivatives or copolymers thereof, an acetylenic alcohol, and an oxyalkylated surfactant of the formula $$Z[(OA)_nOH]_m$$

where Z is the oxyalkylatable moiety of an oxyalkylatable compound $Z(OH)_m$, A is the alkylene moiety of an alkylene oxide, and n is a number from 1 to 2,000.

5. The composition of claim 4 where the polymer is a quaternary polymer of a vinyl pyridine or copolymers thereof.

6. The composition of claim 5 where the vinyl pyridine is 4-vinyl pyridine, 2-vinyl pyridine, 2-methyl-5-vinyl pyridine, derivatives or copolymers thereof.

7. A process according to claim 1 where the system contains corrodable ferrous metal.

8. A process according to claim 2 where the system contains corrodable ferrous metal.

9. A process according to claim 3 where the system contains corrodable ferrous metal.

10. The process of claim 9 where the oxyalkylated surfactant is an oxyalkylated phenol.

11. The process of claim 10 where the oxyalkylated surfactant is an ethoxylated para-nonyl phenol.

12. The composition of claim 6 where the oxyalkylated surfactant is an oxyalkylated phenol.

13. The composition of claim 12 where the oxyalkylated surfactant is an ethoxylated para-nonyl phenol.

* * * * *